US006361187B1

(12) United States Patent
Adams

(10) Patent No.: US 6,361,187 B1
(45) Date of Patent: Mar. 26, 2002

(54) CHRISTMAS TREE OUTDOOR ORNAMENT

(75) Inventor: William E. Adams, Portersville, PA (US)

(73) Assignee: Adams Mfg. Corp., Portersville, PA (US)

( * ) Notice: Subject to any disclaimer, the term of this patent is extended or adjusted under 35 U.S.C. 154(b) by 0 days.

(21) Appl. No.: 09/507,059

(22) Filed: Feb. 21, 2000

Related U.S. Application Data

(63) Continuation-in-part of application No. 08/891,650, filed on Jul. 11, 1997, now Pat. No. 6,027,228.

(51) Int. Cl.[7] ..... F21V 21/092; F21V 21/088

(52) U.S. Cl. ..... 362/252; 362/145; 362/396; 362/397; 362/808

(58) Field of Search ..... 362/123, 145, 362/151, 152, 249, 252, 391, 396, 397, 806, 807, 808

(56) References Cited

U.S. PATENT DOCUMENTS

| | | | | | |
|---|---|---|---|---|---|
| 3,704,366 | A | | 11/1972 | Korb et al. | 362/123 |
| 4,404,621 | A | | 9/1983 | Mauro | 362/419 |
| 4,588,153 | A | | 5/1986 | Boston et al. | 248/74.2 |
| 4,620,270 | A | | 10/1986 | Laakso | 362/123 |
| 5,141,192 | A | | 8/1992 | Adams | 248/231.8 |
| 5,396,408 | A | * | 3/1995 | Szczech, III | 362/397 |
| 5,402,974 | A | | 4/1995 | Adams | 248/205.5 |
| 5,419,527 | A | | 5/1995 | Adams et al. | 248/518 |
| 5,568,966 | A | | 10/1996 | Miller et al. | 362/252 |
| D377,076 | S | | 12/1996 | Adams | D21/255 |
| 5,597,229 | A | * | 1/1997 | Plichta et al. | 362/396 |
| 5,618,103 | A | * | 4/1997 | Fussell | 362/396 |
| 5,707,136 | A | * | 1/1998 | Byers | 362/145 |
| 5,712,002 | A | | 1/1998 | Reilly et al. | 428/20 |
| D391,837 | S | | 3/1998 | Adams et al. | D8/354 |
| 6,022,122 | A | * | 2/2000 | Limardo | 362/397 |
| 6,076,938 | A | * | 6/2000 | Kinderman | 362/249 |
| 6,116,752 | A | * | 9/2000 | Mayfield et al. | 362/252 |
| 6,135,617 | A | * | 10/2000 | Lai | 362/249 |

* cited by examiner

*Primary Examiner*—Alan Cariaso
(74) *Attorney, Agent, or Firm*—Buchanan Ingersoll, P.C.

(57) ABSTRACT

A Christmas tree outdoor ornament has an elongated hook member with one end having a spiral hook and the other end having a hook sized to receive at least one string of decorative lights. A star fits over the body of the hook member. The spiral hook attached to a gutter or a suction cup and decorative light strings are routed from the hook member to anchors creating a triangular tree shape. The anchors may be stakes in the ground or suction cups attached to any flat surface such as a window or window sill.

21 Claims, 6 Drawing Sheets

FIG. 3
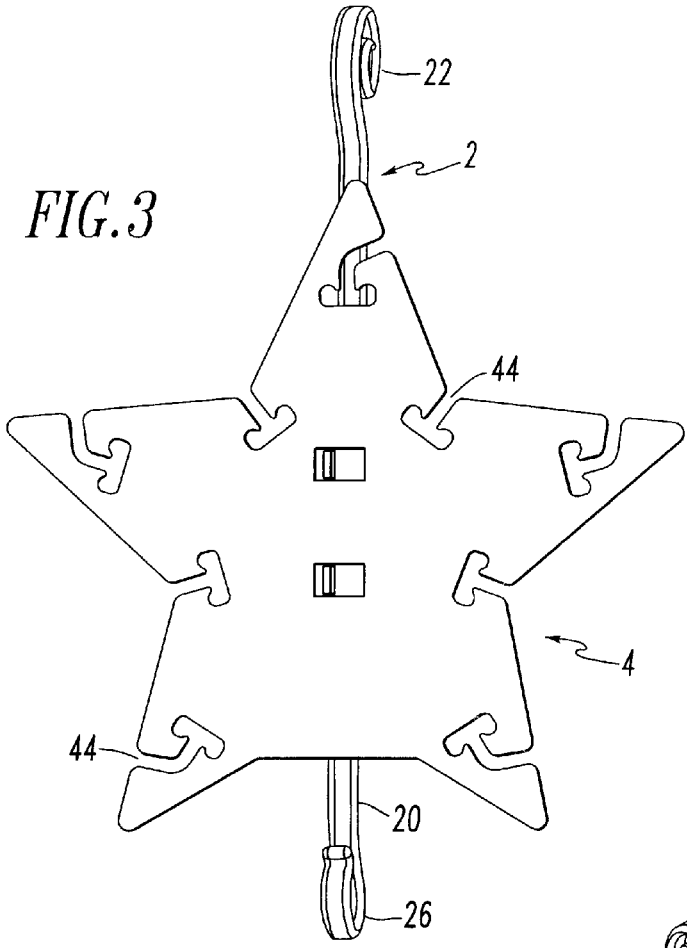
FIG. 4
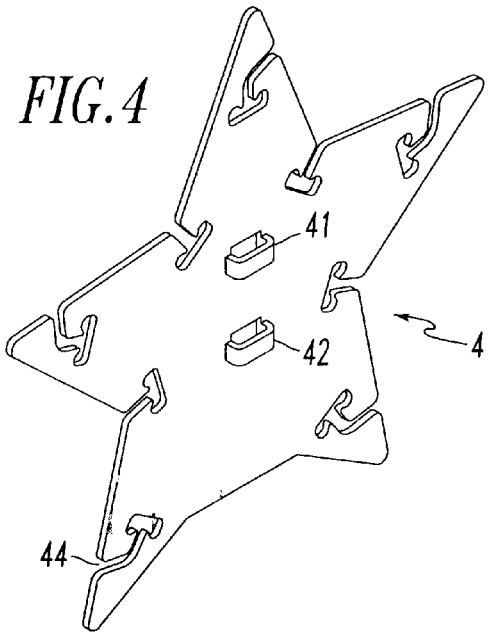
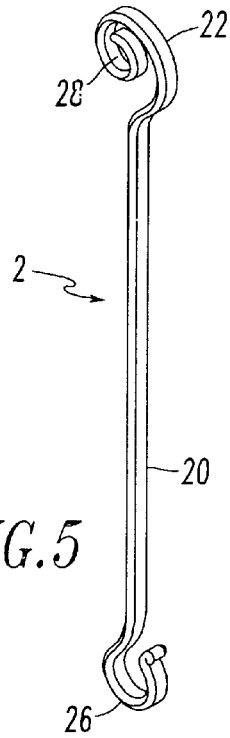
FIG. 5

CHRISTMAS TREE OUTDOOR ORNAMENT

CROSS REFERENCE TO RELATED APPLICATION

This application is a continuation-in-part of U.S. patent application Ser. No. 08/891,650, filed Jul. 11, 1997, now U.S. Pat. No. 6,027,228.

BACKGROUND OF THE INVENTION

1. Field of the Invention

The present invention relates to decorative Christmas ornaments, and more particularly to a lighted Christmas tree ornament.

2. Description of Related Art

Many people decorate their houses during the Christmas season. It is quite common for people to string lights around the exterior of their house using hooks which are fastened to the walls, roof and gutters. Typically the lights are strung in straight lines along the edges or roof line of the house or around windows and doors. Various types of hooks are available to hold Christmas light strings ranging from threaded eyebolts to plastic clips. In my U.S. Pat. No. 5,141,192 I disclose one type of hook for hanging cords from a gutter or the like.

Another type of outdoor Christmas decorations are lawn ornaments. Christmas season lawn ornaments, both lighted and unlighted, and are available in many configurations, from Christmas trees to elves to manger scenes to Santa's sleigh and reindeers. The most common types are constructed from plastic and are anchored to the ground with stakes. Many, if not most, are provided with electric lighting for enhanced effect at night. More closely related to the present invention is a pole or a set of inclined poles extending upward from the ground and having multiple strings of lights strung from the top of the pole or poles and then stacked to the ground. This pattern forms a conical shape which resembles a Christmas tree, especially at night when the strings of lights are lit up and neither the pole nor the strings on which the lights are carried are visible. This type of decoration is disclosed in U.S. Pat. Nos. 3,704,366 to Korb et al.; 4,404,621 to Mauro; 4,620,270 to Laakso; 5,568,966 to Miller et al. and 5,712,002 to Reilly III. This type of tree typically is found in a commercial or public area, is over ten feet high, and was assembled by professionals. Some homeowners have created this type of tree in their yards. However, because of the time and skill required to make such a tree very few people make this decoration.

There are other disadvantages with this type of lighted Christmas tree. One such disadvantage is the fact that wind may cause the strings of electric lights to whip back and forth causing a fair amount of stress on both the lights and electrical wiring. Staking the light strings tighter to reduce the back and forth "whipping" may reduce that problem, but that creates increased tensile stress in the electrical wire. One way to avoid this problem is to place the tree ornament close to the house so that the house will block the wind. However, since many people have shrubs next to their houses, this solution is impractical.

Therefore, there is a need for a new Christmas tree outdoor ornament that can be easily assembled by a homeowner, and which can be placed close to the house or onto the house.

SUMMARY OF THE INVENTION

I provide a Christmas tree lawn ornament having a star within two hooks. One hook has a spiral end that is securely clipped onto the gutter and the second hook receives a string or strings of decorative lights that run from the hook in an outward triangular pattern representative of a Christmas tree. The lights can be anchored into the ground with stakes or attached to a flat surface on or near the ground with suction cups or attached to the wall of the house with suction cups or hooks. Multiple guide wires can be provided which run from the hook. The guide wires are anchored to the ground at some distance apart in a line or in a generally semi-circular pattern. The outline of the guide wires form a shape simulating a Christmas tree. If guide wires are used multiple light holders can be provided which can be slidingly attached to the guide wires. These light holders preferably are sized and shaped to hold a decorative light socket. Strings of electric lights or other decorations can then be attached to the light holders. The light holders allow strings of electric lights to be positioned parallel, perpendicular, or at varying angles to the guide wires. The light holders may be spaced apart from one another in a manner determined by the person who sets up the tree.

In another embodiment a large suction cup with a loop is provided to attach the hook onto the house. The spiral end of the hook encircles the loop portion of the suction cup providing a secure attachment. The suction cup is then attached to a window or other smooth surface. Then the light strings are routed from the lower hook to form the triangular tree shape.

Other details, objects, and advantages of the invention will become apparent from the following description and accompanying drawings of certain presently preferred embodiments thereof.

BRIEF DESCRIPTION OF THE DRAWING FIGURES

In the accompanying drawings, the preferred embodiments of the invention and preferred method of practicing the invention are illustrated in which:

FIG. 3 is a front perspective view of the star and hook members of the ornament shown FIGS. 1 and 2;

FIG. 4 is a rear perspective view of the star member of the ornament shown in FIGS. 1 and 2;

FIG. 5 is a perspective view of the hook member of the ornament shown in FIGS. 1 and 2;

DETAILED DESCRIPTION OF CERTAIN EMBODIMENTS

Figure 1:
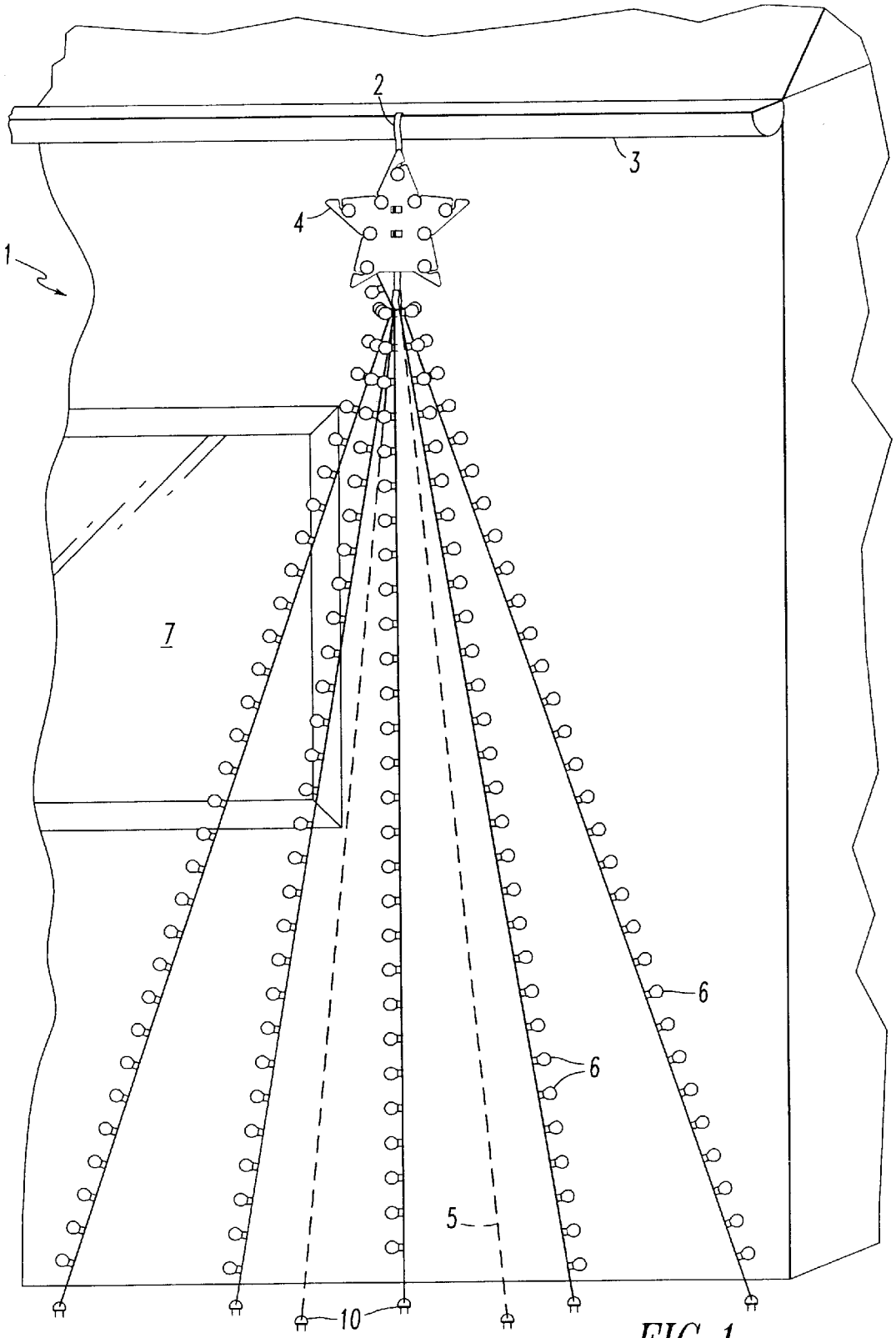
FIG. 1 is a perspective view of a present preferred embodiment of my Christmas tree outdoor ornament.
Figure 7:
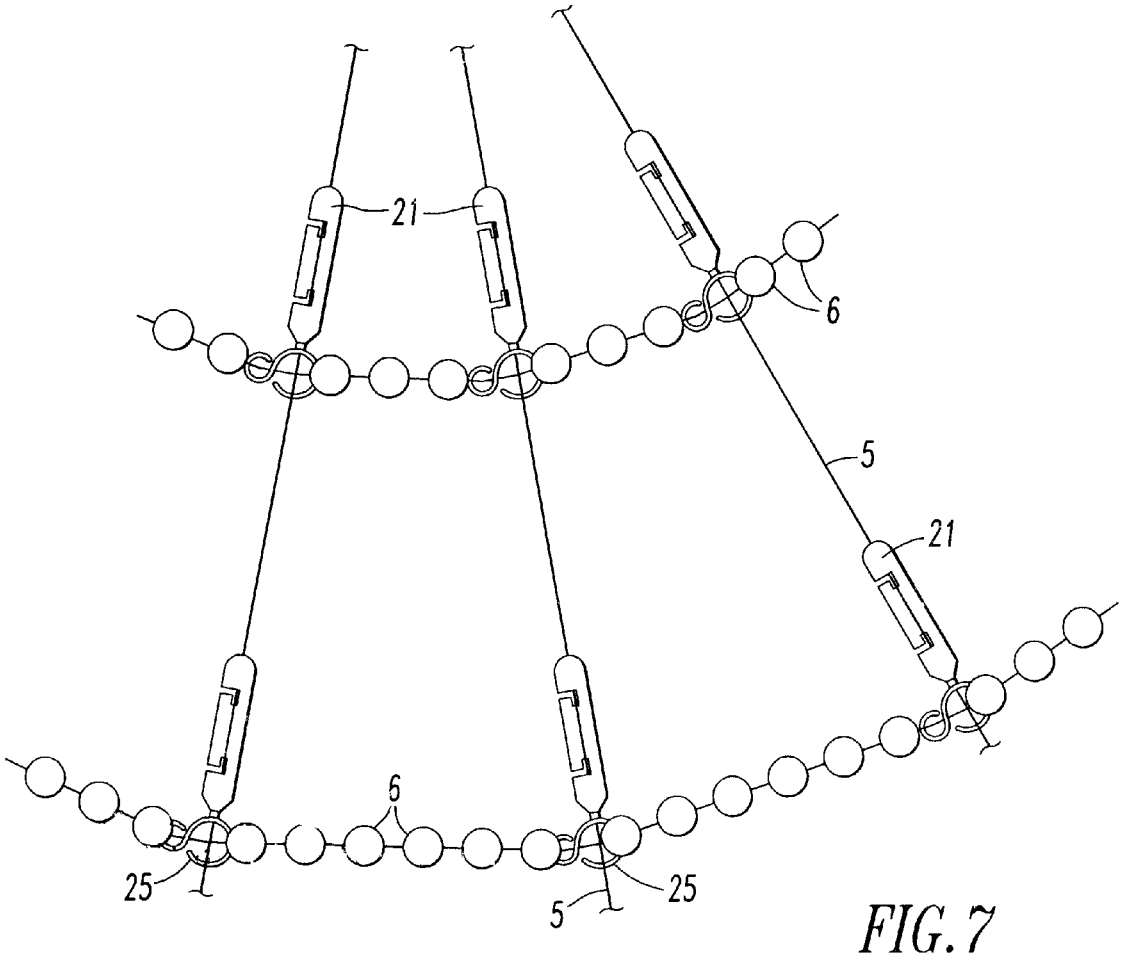
FIG. 7 is a perspective view partially in section illustrating how multiple light holders like the one shown in FIG. 6 may be positioned on the guide wires.

Referring now to the drawings wherein like reference numerals refer to similar or identical parts throughout the several views. A first presently preferred outdoor Christmas tree ornament, shown in FIG. 1, includes hook member 2 that carries a star 4. If desired another decorative shape could be used in place of the star. The hook member 2 has a gutter hook 22 at one end which fits into the lip of a gutter 3 attached to house 1. A second hook 26 is provided at the opposite end of the hook member 2. One or more strings of Christmas lights 6 are routed from the second hook 26 to stakes 10 in the ground. If desired, multiple guide wires 15 shown in dotted line can be provided which are also anchored to the ground by stakes 10. I prefer to use stakes of the type shown in my U.S. Design Pat. No. Des. 337,076, but any suitable stake having a top portion to which the light strings 6 and the ends of the guide wires 5 can be attached could be used. If guide wires are used the light strings can be attached to the guide wires as shown in FIG. 7.

Figure 2:
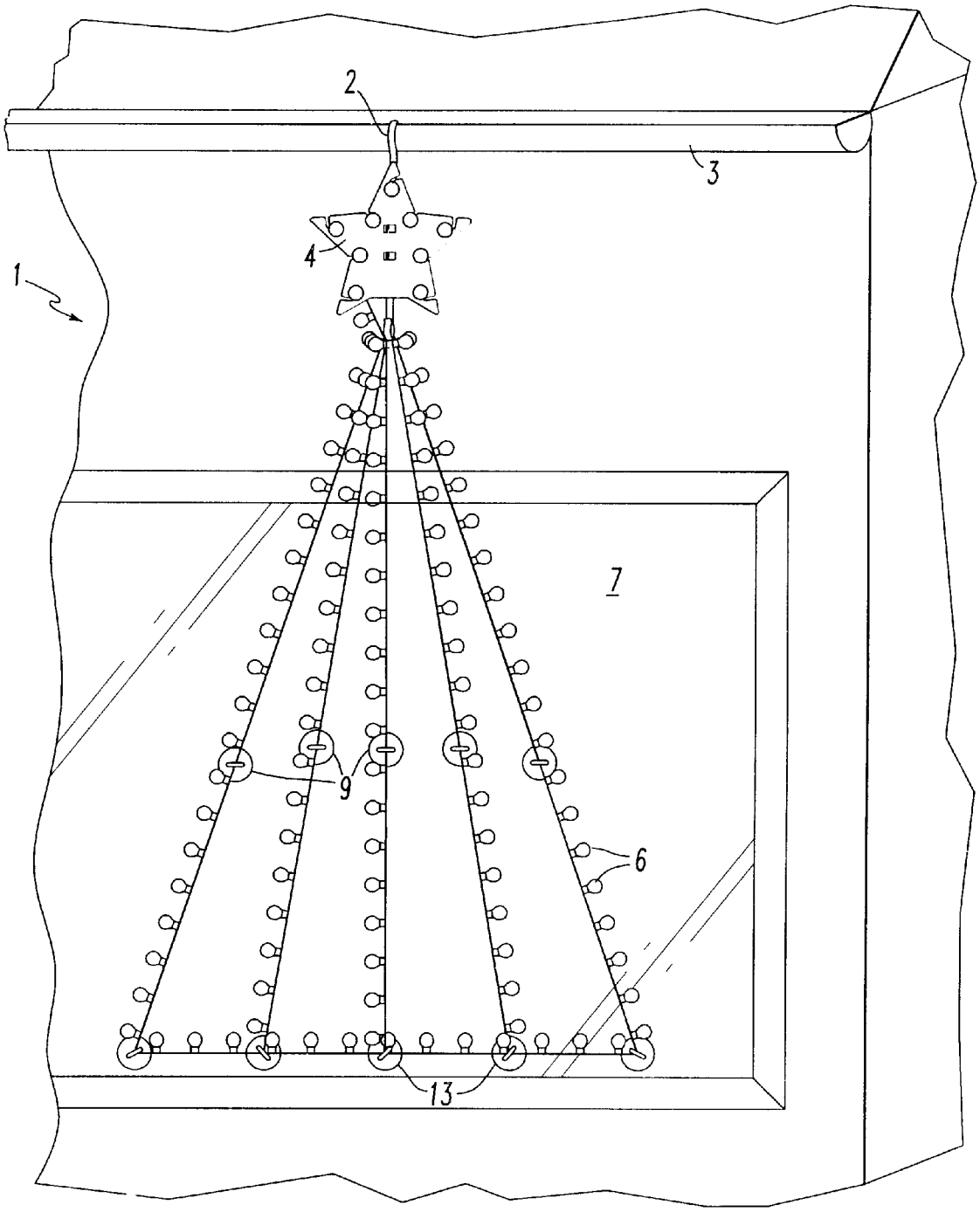
FIG. 2 is a perspective view of a second present preferred embodiment of my Christmas tree outdoor ornament.

In an alternative embodiment shown in FIG. 2, the light strings 6 are attached to a window 7 with suction cups 12. One type of suction cup that can be used to attach the lights to the window is disclosed in my U.S. Pat. No. 5,402,974. The light strings could also be attached to the window sill using suction cups 12 shown in dotted line. One could use the same type of suction cups as used on the window. I prefer, however, to use a suction cup with loop such as is disclosed in my U.S. Pat. No. Des. 391,837.

Referring to FIGS. 3, 4 and 5, the star-shaped member 4 has a pair of clips 41 and 42 which fit over the main body portion 20 of the hook member 2 holding the star 4 on the hook member. Alternatively, a tab may extend from the hook member which fits into a receiving slot in the star 4. This type of construction is shown in my U.S. Pat. No. 5,419,527. The star-shaped member 4 is also provided with multiple decorative light holder openings 44 for holding a string of decorative lights. The openings 44 preferably are T-shaped so that a light socket can be more securely held in the opening.

The gutter hook 22 preferably has a spiral segment 28 that allows the hook member to be easily attached over the lip of a gutter. The spiral portion grips the gutter to securely hold the ornament in place. In my U.S. Pat. No. 5,141,192, I disclose a gutter hook having a similar spiral hook. There I illustrate how this spiral hook can be securely placed on the gutter. When properly installed the ornament will not come loose or slide along the gutter.

Figure 8:
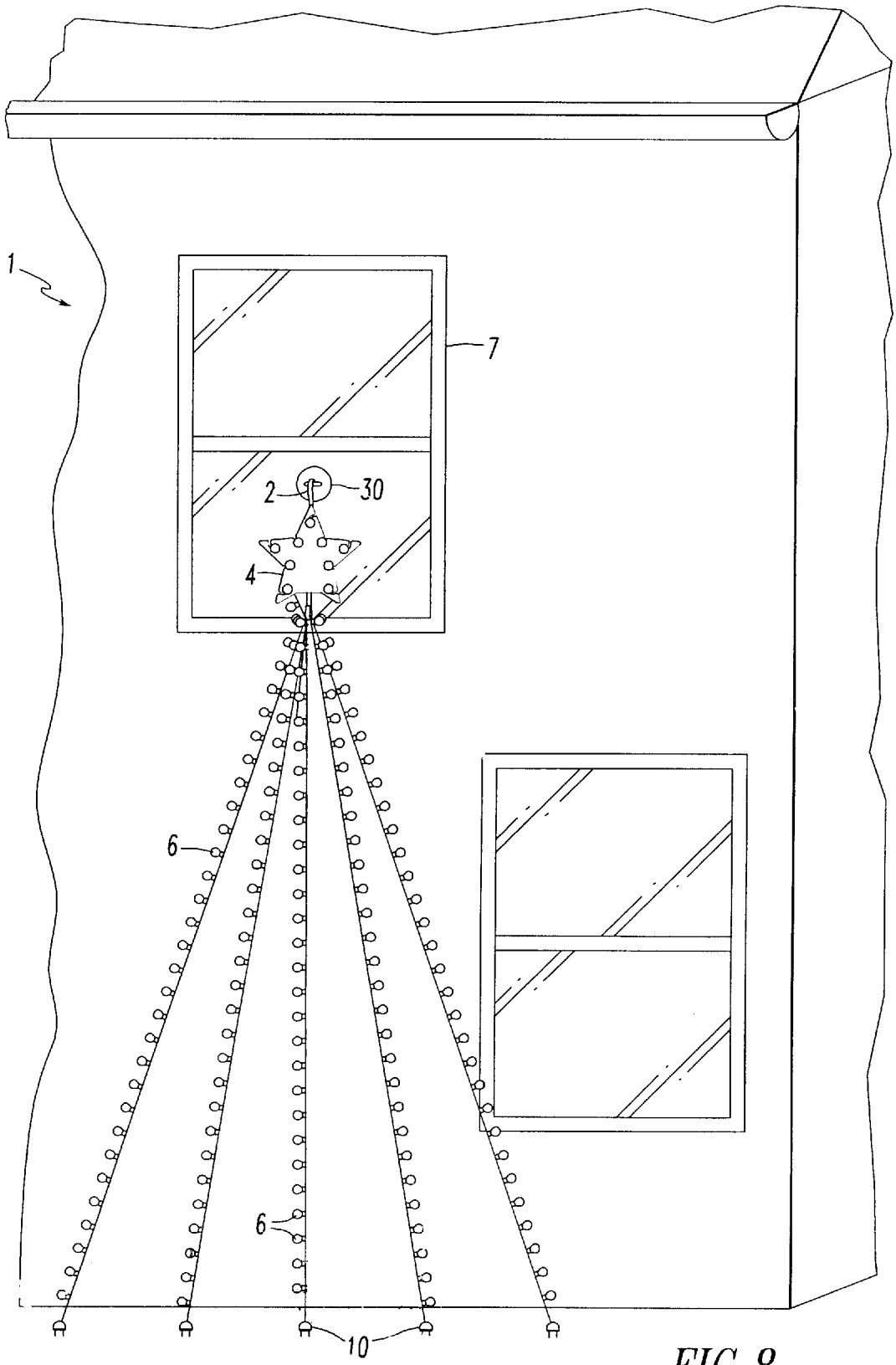
FIG. 8 is a perspective view of a third present preferred embodiment of my Christmas tree outdoor ornament.
Figure 9:
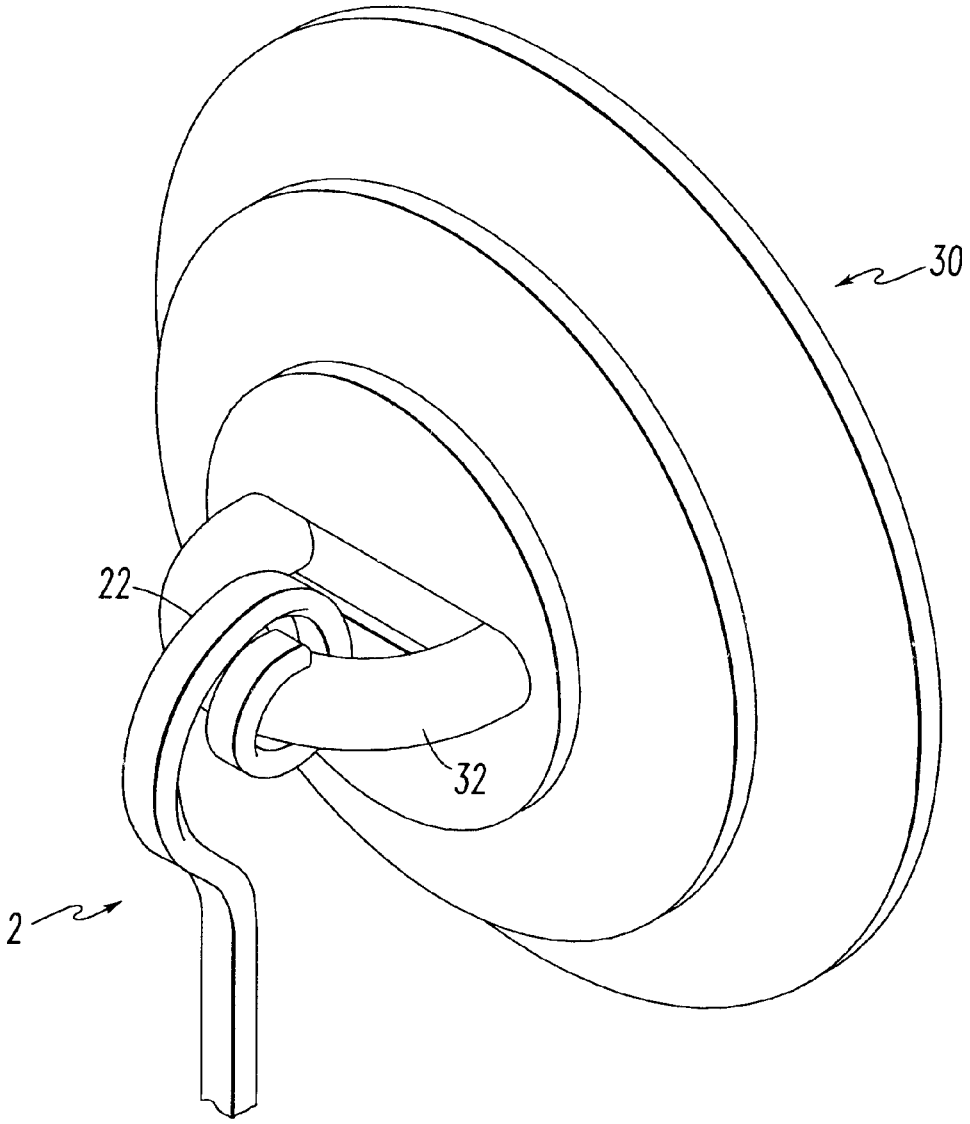
FIG. 9 is a front perspective view of the large suction cup with loop used in the embodiment of the ornament shown in FIG. 8 with the spiral end of the hook attached.

Referring to FIGS. 8 and 9 a third present preferred embodiment has a large suction cup 30 with a loop 32. The suction cup is attached to a window 7 or other flat smooth surface. This suction cup should have a diameter of not less than 2½ inches and preferably be 3½ inches in diameter. Such a suction cup should be able to hold at least 30 pounds. The spiral end 28 of the hook member 2 encircles the loop 32 to provide a secure attachment of the ornament to the suction cup. As in the previous embodiments a star 2 is attached to the body of the hook member 2 and lights are strung from the lower hook 26 to anchors below the hook such as stakes 10. From this embodiment it should be apparent that other fasteners having a loop portion that can be held by the spiral end in the manner shown in FIG. 9 could be used. I prefer to package the lawn ornament in kit form to be assembled by the user. The kit contains the hook member, star and seven stakes. A kit for the third embodiment would also contain a large suction cup. The kit may also include a spool of guide wire that contains a length of guide wire. The guide wire may be sufficiently long to be looped in a sinusoidal manner from the hook 26 to each of the stakes 10.

To construct the tree, the hook member 2 is clipped onto the star 4 as shown in FIG. 3. Decorative lights are placed in the slots 44 in the star. Typically, this will be one end of a string of decorative lights. Then the gutter hook 22 is attached to the gutter. The portion of the light string not in the star is routed between the hook 26 and stakes 10 in the ground or suction cups 12, 13 on a flat surface to create a triangular shape. If desired, one guide wire 15 can be tied or otherwise attached to the hook 26 with the opposite end being tied or otherwise attached to a stake 10 which anchors the guide wires 5 to the ground. Alternatively, the guide wires may be looped from one stake 10 up around the hook 26, then back down to the next stake 10 and back up around the hook 26, and so on. By looping the guide wire in sinusoidal manner like this a single strand of guide wire, of sufficient length, can be utilized to create the Christmas tree shape. Then strings of lights could be attached to the guide wires by light holders.

Figure 6:
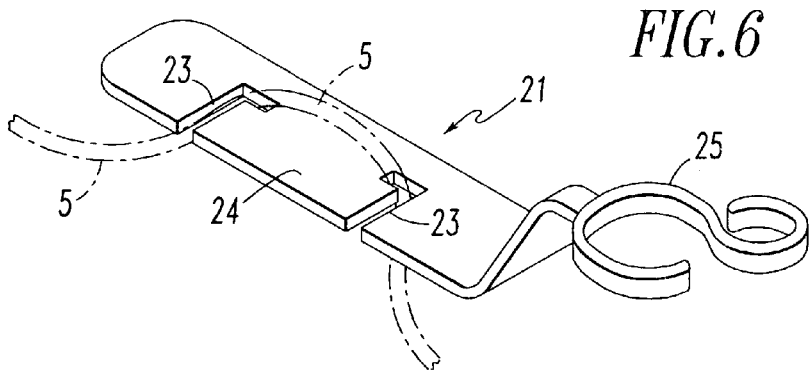
FIG. 6 is a perspective view of a presently preferred embodiment of a light holder.

Multiple light holders, preferably like the holder 21 illustrated in FIGS. 6 and 7, are provided which can be attached at various positions along the guide wires 5. The light holder 21 has a front holding portion 25 which is adapted to hold decorative lights. Preferably, this portion is resilient plastic and S-shaped, having a first opening sized to hold mini-light bulb sockets and a second opening sized to hold the larger standard size (C-4) and outdoor size (C-9) decorative light sockets. The light holder 21 could have tabs, slots or other structures adapted to hold other types of decorations. The flat rear portion 24 of the light holder 21 is provided with two narrow L-shaped slots 23 which are sized and configured to frictionally engage a guide wire 5 threaded through the slots. Holders can be placed at any desired position along a guide wire 5 as shown in FIG. 7. A light socket from a string of decorative lights 6 is attached to the holding portion 25 of each light holder 21. Although a horizontal design is shown in FIG. 7, the strings of lights 23 may also be positioned parallel to the guide wires 5, or at varying angles, according to personal preference.

The hook member 2 and star 4 are preferably molded from plastic such as polycarbonate. The stakes may also be molded plastic. Consequently, this ornament is inexpensive and easy to assemble.

Even though the preferred embodiment has a star shaped member it should be understood that this member could be shaped like other top ornaments used on Christmas trees such as an angel.

Although the invention has been described in detail in the foregoing embodiments for the purpose of illustration, it is to be understood that the invention is not so limited but may be variously embodied with the scope of the following claims.

I claim:

1. A Christmas tree outdoor ornament comprising:

a hook member having an elongated body with a spiral hook at one end, a second hook at an opposite end, the second hook sized and shaped to receive portions of decorative light strings which are routed from the second hook to remote anchoring locations and an intermediate body portion connected between the spiral hook and the second hook; and a decorative shaped member attached to the intermediate body portion.

2. The Christmas tree outdoor ornament of claim 1 also comprising a plurality of anchors and a plurality of guide wires, each guide wire having a first end and a second end, each first end attached to the second hook and each second end attached to one of the plurality of anchors.

3. The Christmas tree outdoor ornament of claim 2 also comprising a plurality of decorative light holders, each light holder attached to a guide wire, and at least one string of decorative lights held by the light holders.

4. The Christmas tree outdoor ornament of claim 2 wherein said anchors are stakes.

5. The Christmas tree outdoor ornament of claim 1 wherein the decorative shaped member is a star shaped member.

6. The Christmas tree outdoor ornament of claim 5 wherein said anchors are selected from the group consisting of stakes and suction cups.

7. The Christmas tree outdoor ornament of claim 1 further comprising a plurality of anchors and at least one string of decorative lights mounted between the second hook and the anchors.

8. The Christmas tree outdoor ornament of claim 1 also comprising a suction cup attached to the spiral hook.

9. A Christmas tree outdoor ornament comprising:

a hook member having an elongated body with a first hook at one end, a second hook at an opposite end, the second hook sized and shaped to receive portions of decorative light strings which are routed from the second hook to remote anchoring locations and an intermediate body portion connected between the spiral hook and the second hook;

a decorative shaped member attached to the intermediate body portion;

a plurality of anchors; and at least one string of decorative lights connected between the second hook and at least some of the plurality of anchors.

10. The Christmas tree outdoor ornament of claim 9 also comprising a suction cup attached to the first hook.

11. The Christmas tree outdoor ornament of claim 9 wherein the decorative shaped member is a star shaped member.

12. The Christmas tree outdoor ornament of claim 9 wherein said anchors are selected from the group consisting of stakes and suction cups.

13. The Christmas tree outdoor ornament of claim 9 also comprising a plurality of guide wires, each guide wire having a first end and a second end, each first end attached to the second hook and each second end attached to one of the plurality of anchors.

14. The Christmas tree outdoor ornament of claim 13 also comprising a plurality of decorative light holders, each light holder attached to a guide wire and the at least one string of decorative lights held by the light holders.

15. A Christmas tree outdoor ornament kit having component parts comprising:

a hook member having an elongated body with a spiral hook at one end and a second hook at an opposite end, the second hook sized and shaped to receive portions of decorative light strings which are routed from the second hook to remote anchoring locations;

a decorative shaped member having clips to permit the shaped member to be attached to the body of the hook member; and a plurality of stakes each stake configured to receive one of the decorative light strings at one of the remote anchoring locations.

16. The kit of claim 15 also comprising a sufficient length of guide wire to extend from said second hook to each of said plurality of stakes.

17. The kit of claim 16 also comprising a plurality of decorative light holders each light holder adapted to be attached to said guide wire.

18. The kit of claim 16 wherein said sufficient length of guide wire comprises a plurality of guide wires each being of sufficient length to extend from said second hook to one of said plurality of stakes.

19. The kit of claim 16 wherein said sufficient length of guide wire comprises a spool of guide wire, said spool containing a length of guide wire sufficiently long to be looped in a sinusoidal manner from the second hook to each of said plurality of stakes.

20. The kit of claim 15 also comprising at least one string of decorative lights of sufficient length to be routed from the second hook to at least one of the stakes at one of the remote anchoring locations.

21. The kit of claim 15 also comprising at least one suction cup having a loop sized to receive the spiral hook.

* * * * *